US007312792B2

(12) United States Patent
Kim et al.

(10) Patent No.: US 7,312,792 B2
(45) Date of Patent: Dec. 25, 2007

(54) METHOD AND APPARATUS FOR DRIVING A PLASMA DISPLAY PANEL

(75) Inventors: Oe Dong Kim, Seongnam-si (KR); Jung Hun Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 585 days.

(21) Appl. No.: 10/850,437

(22) Filed: May 21, 2004

(65) Prior Publication Data

US 2005/0030259 A1 Feb. 10, 2005

(30) Foreign Application Priority Data

May 23, 2003 (KR) ..... 10-2003-0033106

(51) Int. Cl.
*G09G 3/28* (2006.01)

(52) U.S. Cl. ..... 345/208; 345/60; 315/169.4

(58) Field of Classification Search ..... 345/208, 345/60, 37; 315/169.4

See application file for complete search history.

(56) References Cited

U.S. PATENT DOCUMENTS 6,249,087 B1 * 6/2001 Takayama et al. ..... 315/169.1
6,621,229 B2 * 9/2003 Kanazawa et al. ..... 315/169.3
6,667,579 B2 * 12/2003 Kanazawa et al. ..... 315/169.3
6,768,478 B1 * 7/2004 Wani et al. ..... 345/60
2001/0017605 A1 * 8/2001 Hashimoto et al. ..... 345/60
2004/0090395 A1 * 5/2004 Park ..... 345/41

* cited by examiner

*Primary Examiner*—Sumati Lefkowitz
*Assistant Examiner*—Seoyun Moon
(74) *Attorney, Agent, or Firm*—Ked & Associates, LLP

(57) ABSTRACT

The present invention relates to a plasma display panel, and more specifically, a method and an apparatus for driving a plasma display panel. According to the present invention, a method for driving a plasma display panel in which pluralities of first electrodes and second electrodes are arranged parallel and to each other adjacently on an upper substrate, a plurality of third electrodes is arranged to cross the pairs of first and second electrodes at electrode crossing areas and define corresponding discharge cells at the electrode crossing areas on an lower substrate, wherein said method for driving a plasma display panel comprises steps of: forming wall charges on the upper and lower substrate by applying first rising ramp waveform to said first electrodes during a first period of a reset period; erasing partly the wall charges which are formed on the upper substrate by applying second rising ramp waveform to said second electrodes during a second period of a reset period; erasing partly the wall charges which are formed on the upper and lower substrates by applying falling ramp waveform to said first and second electrodes during a third period of a reset period; selecting the discharge cells by applying data voltage to said third electrodes and applying scan voltage to said first electrodes during a address period; and displaying an image on screen by applying sustain voltage to said first and second electrodes alternatively during a sustain period.

29 Claims, 15 Drawing Sheets

METHOD AND APPARATUS FOR DRIVING A PLASMA DISPLAY PANEL

This Nonprovisional application claims priority under 35 U.S.C. § 119(a) on Patent Application No. 10-2003-033106 filed in Korea on May 23, 2003, the entire contents of which are hereby incorporated by reference.

BACKGROUND OF THE INVENTION

1. Field of the Invention

The present invention relates to a plasma display panel, and more specifically, a method and an apparatus for driving a plasma display panel.

2. Description of the Background Art

A plasma display panel (hereinafter, referred to as "PDP") displays images including characters or graphics since fluorescent material is emitted by ultraviolet rays of 147 nm occurring when inert mixed gases of He+Xe, Ne+Xe, He+Ne+Xe, etc. are discharged. It is easy for this PDP to be made thin and large. The PDP also provides an improved picture quality due to recent advanced technology. In particular, in a 3-electrode AC sheet discharge PDP, wall charges are accumulated on the surface of the PDP upon the discharge of the PDP and electrodes are protected from sputtering occurring due to the discharge. Therefore, the 3-electrode AC sheet discharge PDP advantageously has a low-voltage driving and a long life span.

FIG. 1 shows a schematic diagram illustrating an arrangement of electrodes in a plasma display panel. FIG. 2 shows a perspective view illustrating a discharge cell structure of a 3-electrode ac surface discharge plasma display panel.

As shown in FIG. 1 and FIG. 2, a 3-electrode ac surface discharge PDP includes scan electrodes Y1 through Yn and sustain electrodes Z which are formed on an upper substrate, and address electrodes X1 through Xm which are formed on a lower substrate.

Discharge cells 1 of the PDP are formed at the crossing areas of the scan electrodes Y1 through Yn, the sustain electrodes Z, and the address electrodes X1 through Xm.

Each of the scan electrodes Y1 through Yn and the sustain electrodes Z includes transparent electrodes 12, and metal bus electrodes 11 of which width is less than those of the transparent electrodes 12 and which are formed in an edge region of one side of the transparent electrodes. The transparent electrodes 12 are usually made of indium-tin-oxide (hereinafter, referred to as "ITO") and formed on the upper substrate 10.

The metal bus electrode 11, usually metal, are formed on the transparent electrodes 12 and serve to reduce a voltage drop by the transparent electrodes 12 having a high resistance. An upper dielectric layer 13 and a protection film 14 are stacked on the upper substrate 10 on which the scan electrodes Y1 through Yn and the sustain electrodes Z are formed. Wall charges which are generated in plasma discharge are stacked on the upper dielectric layer 13. The protection film 14 serves to prevent damage of the electrodes Y1 through Yn, Z and the upper dielectric layer 13 due to sputtering occured upon the plasma discharge and to increase emission efficiency of secondary electrons. The protection film 14 is usually made of magnesium oxide (MgO).

The address electrodes X1 through Xm are formed in in the direction intersecting the scan electrodes Y1 through Yn and the sustain electrodes Z on the lower substrate 18. Lower dielectric layer 17 and a diaphragm 15 are formed on the lower substrate 18. Fluorescent material layer 16 is formed on the surface of the lower dielectric layer 17 and the diaphragm 15. The diaphragm 15 is formed in parallel to the address electrode X1 through Xm, divides the discharge cells physically, and serves to prevent electric or optical interferences between the neighboring discharge cells 1. Thin fluorescent material layer 16 is excited by ultraviolet rays, which are generated upon the plasma discharge, and generates a visible ray of one of red, green and blue.

Inert mixed gas such as He+Xe, Ne+Xe or He+Ne+Xe for discharge is inserted into a discharge space of the discharge cell formed between the upper/lower substrates 10, 18 and the diaphragm 15.

In such a 3-electrode AC sheet discharge type PDP, one frame is driven with it divided into several sub-fields having different numbers of emission in order to implement the gray level of a picture. As shown in FIG. 3, if it is desired to display a picture using 256 gray scales, the frame period 16.67 ms corresponding to 1/60 second is divided into eight sub-fields SF1 to SF8. Each sub-field SF1 through SF8 is divided into a reset period during which the discharge cells are initialized, an address period during which the discharge cells are selected, and a sustain period which gray level is implemented by the number of discharge. The reset and address period of each sub-field are same in every sub-field, whereas the sustain period and the number of the discharge are increased in the ratio of 2n(n=0,1,2,3,4,5,6,7) in each sub-field.

FIG. 4 shows a waveformform illustrating the driving method of a plasma display panel. As shown in FIG. 4, during setup period SU of the reset period, rising ramp waveform Ramp-up is simultaneously applied to all the scan electrodes Y. At the same time, O[V] is applied to the sustain electrodes Z and the address electrodes X. Setup discharge, little discharge, is generated between the scan electrodes and the address electrodes, or between the scan electrodes and the sustain electrodes in the cells of total screen by the rising ramp waveform Ramp-up. By this setup discharge, wall charges of positive polarity are stacked on the address electrodes X and the sustain electrodes Z, and wall charges of negative polarity are stacked on the scan electrodes Y. During setdown period SD of the reset period, falling ramp waveform Ramp-dn, which falls from about the sustain voltage Vs to the ground voltage GND or O[V], is simultaneously applied to the scan electrodes.

While this falling ramp waveform Ramp-dn is applied to the scan electrodes Y, the sustain voltage Vs is applied to the sustain electrodes Z and O[V] is applied to the address electrodes X. When this falling ramp waveform Ramp-dn is applied, setdown discharge, little discharge, is generated between the scan electrodes Y and the sustain electrodes Z, and between the scan electrodes and the address electrodes. By this setdown discharge, wall charges, which are unnecessary for address discharge among wall charges formed by setup discharge, are erased.

Examining change of wall charges during the reset period, the change of wall charges on the address electrodes almostly can not be found, and wall charges of negative polarity, which are formed on the scan electrodes by the setup discharge, are erased partly. On the other side, on the sustain electrodes Z, wall charges of positive polarity was formed by the setup discharge. However, wall charges of negative polarity are stacked as many as the reduction quantity of negative polarity wall charges of the scan electrodes by the setdown discharge.

During the address period, the scan pulse SP of the negative polarity is sequentially applied to the scan electrodes Y and at the same time the data pulse DP of the positive polarity is synchronized with the scan pulse SP and applied to the address electrodes X. As the voltage difference between the scan pulse SP and the data pulse DP and the wall voltage generated in the reset period are added, an address discharge is generated within a cell to which the data pulse DP is applied. Wall charges are generated within the cell selected by the address discharge and the wall charges can generate discharge by applying the sustain voltage Vs. During this address period, positive polarity dc voltage Zdc is applied to the sustain electrodes Z.

During the sustain period, sustain pulses SUS are alternately applied to the scan electrodes Y and the sustain electrodes Z. Then, in the cell selected by the address discharge, sustain discharge, that is display discharge, is generated between the scan electrodes Y and the sustain electrodes Z every time when every sustain pulse is applied, while the wall voltage and the sustain pulse SUS within the cell are added thereto.

In the erase period following the sustain period, wall charges, which remain in the cells of the total screen, are erased by applying the erase ramp waveform RAMP-ERS, of which the pulse width is narrow and the voltage level is low, to the sustain electrodes Z.

In case that the voltage of the falling ramp waveform falls only to zero O[V] like the driving waveform of FIG. 4, the erasing work, by which the wall charges, which is necessary for the address discharge, are leaved uniformly in the all discharge cells, is not achieved well. Because of this, the method, through which the voltage of the falling ramp waveform falls to negative polarity voltage and the erasing discharge is achieved enoughly and uniformly, has been developed.

Recently, the pixel of the PDP is rising and the picture quality of the PDP is being improved. However, as the subfield is added for rising the pixel or improving the picture quality, the address driving time becomes longer and the driving time for the PDP becomes insufficient. This insufficiency of driving time for the PDP can be solved by dual-scan method which can scan two lines simultaneously. However, in this dual-scan method, Drive Integrated Circuit must be added. Therefore, recently, the research for improving the picture quality by using single scan is being advanced actively.

Further, recently, for improving efficiency of PDP, a method, which increases the content of Xe more than 10%, was proposed. However, if the content of Xe is increased like this, the ramp voltage of the reset period increases and the discharge is delayed. Specially, as the value of the address jitter is increased, the scan period and the address period is increased, PDP can not be drived by single scan, the driving margin becomes smaller, and the sustain work becomes unstable.

SUMMARY OF THE INVENTION

Accordingly, an object of the present invention is to solve at least the problems and disadvantages of the background art.

An object of the present invention is to provide a method and an apparatus for driving a plasma display panel, which can reduce the discharge delay, make the single scan possible, make the driving margin large, and make the sustain discharge stable by controlling the quantity of wall charges.

According to an aspect of the present invention, a method for driving a plasma display panel in which pluralities of first electrodes and second electrodes are arranged parallel and to each other adjacently on an upper substrate, a plurality of third electrodes is arranged to cross the pairs of first and second electrodes at electrode crossing areas and define corresponding discharge cells at the electrode crossing areas on an lower substrate, wherein said method for driving a plasma display panel comprises steps of: forming wall charges on the upper and lower substrate by applying first rising ramp waveform to said first electrodes during a first period of a reset period; erasing partly the wall charges which are formed on the upper substrate by applying second rising ramp waveform to said second electrodes during a second period of a reset period; erasing partly the wall charges which are formed on the upper and lower substrates by applying falling ramp waveform to said first and second electrodes during a third period of a reset period; selecting the discharge cells by applying data voltage to said third electrodes and applying scan voltage to said first electrodes during a address period; and displaying an image on screen by applying sustain voltage to said first and second electrodes alternatively during a sustain period.

According to another aspect of the present invention, a method for driving a plasma display panel including an upper substrate on which pluralities of first electrodes and second electrodes are arranged parallel and to each other adjacently and a lower substrate on which a plurality of third electrodes is arranged to cross the pairs of first and second electrodes at electrode crossing areas and define corresponding discharge cells at the electrode crossing areas and wherein, during a reset period, each of the discharge cells is initialized, during an addressing period, wall charges are provided in the discharge cells according to display data and, during a sustain discharge period, sustain discharges are induced in discharge cells in which wall charges are provided during the addressing period, wherein said reset period comprises: first initializing period during which wall charges are formed on the upper and lower substrates; second initializing period during which some of wall charges, formed on the upper substrate, are elimineted; and third initializing period during which some of wall charges, formed on the upper and lower substrates, are erased.

According to another aspect of the present invention, a apparatus for driving a plasma display panel in which pluralities of first electrodes and second electrodes are arranged parallel and to each other adjacently on an upper substrate, a plurality of third electrodes is arranged to cross the pairs of first and second electrodes at electrode crossing areas and define corresponding discharge cells at the electrode crossing areas on an lower substrate, wherein said apparatus for driving a plasma display panel comprises: first electrode driving part which applies first rising ramp waveform to said first electrodes during first period of reset period, applies first falling ramp waveform to said first electrodes during third period of reset period, applies scan voltage to said first electrodes during address period, and then, applies sustain voltage to said first electrodes during sustain period; second electrode driving part which applies second rising ramp waveform to said second electrodes during second period of reset period, applies second falling ramp waveform to said second electrodes during third period of reset period, and then, applies sustain voltage to said second electrodes during sustain period alternatively with said first electrode driving part; and third electrode driving part which applies data voltage to said third electrodes during address period.

According to further aspect of the present invention, A method for driving a plasma display panel in which pluralities of first electrodes and second electrodes are arranged parallel and to each other adjacently on an upper substrate, a plurality of third electrodes is arranged to cross the pairs of first and second electrodes at electrode crossing areas and define corresponding discharge cells at the electrode crossing areas on an lower substrate, wherein said method for driving a plasma display panel comprises steps of: forming wall charges on the upper and lower substrate by applying first rising ramp waveform to said second electrodes during a first period of a reset period; forming further wall charges on the upper and lower substrate by applying second rising ramp waveform to said first electrodes during a second period of a reset period; erasing partly the wall charges which are formed on the upper and lower substrates by applying falling ramp waveform to said first and second electrodes during a third period of a reset period; selecting the discharge cells by applying data voltage to said third electrodes and applying scan voltage to said first electrodes during a address period; and displaying an image on screen by applying sustain voltage to said first and second electrodes alternatively during a sustain period.

BRIEF DESCRIPTION OF THE DRAWINGS

The invention will be described in detail with reference to the following drawings in which like numerals refer to like elements.

DETAILED DESCRIPTION OF PREFERRED EMBODIMENTS

Figure 1:
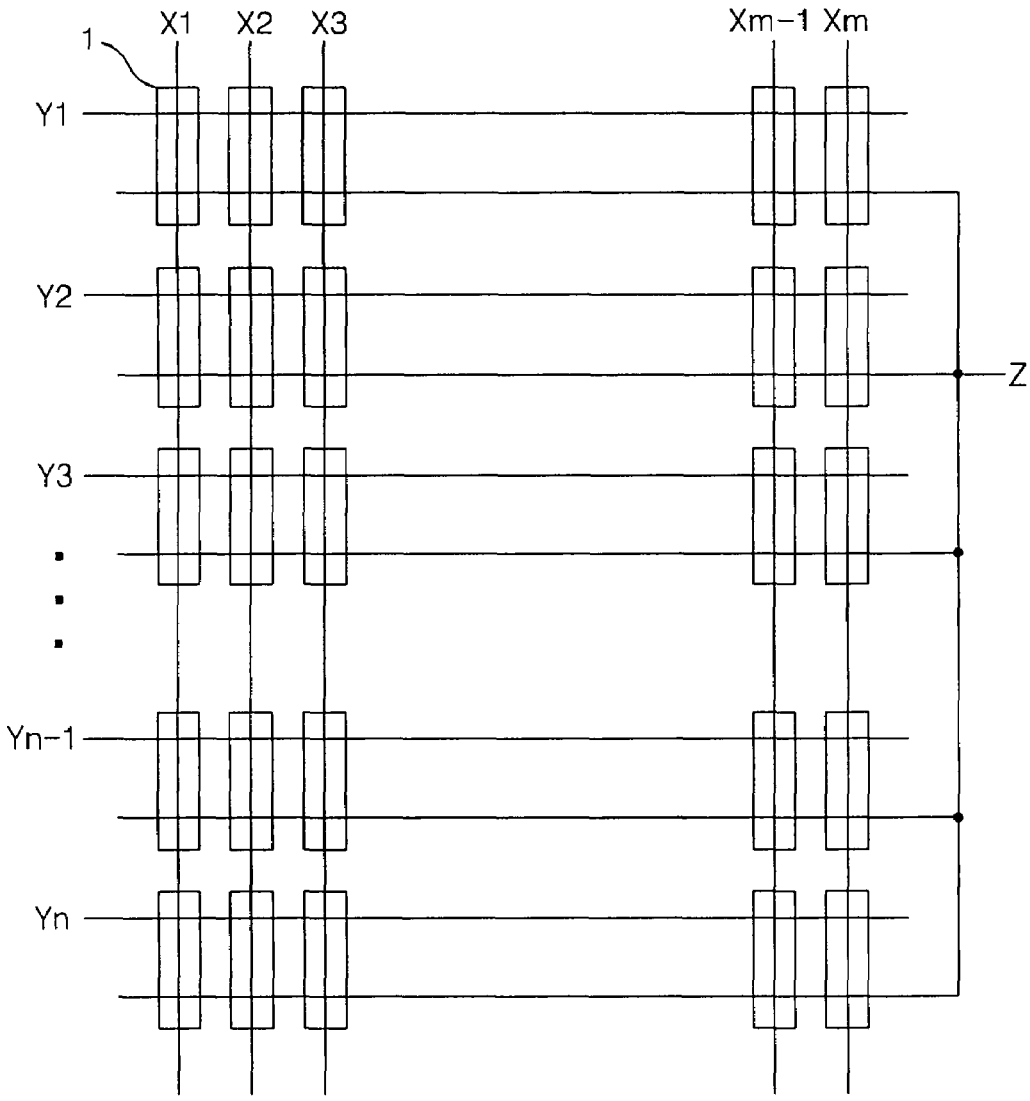
Fig. 1 Prior Art
FIG. 1 shows a plane view illustrating electrodes arrangement: of a 3-electrode ac surface discharge plasma display panel of the background art.
Figure 2:
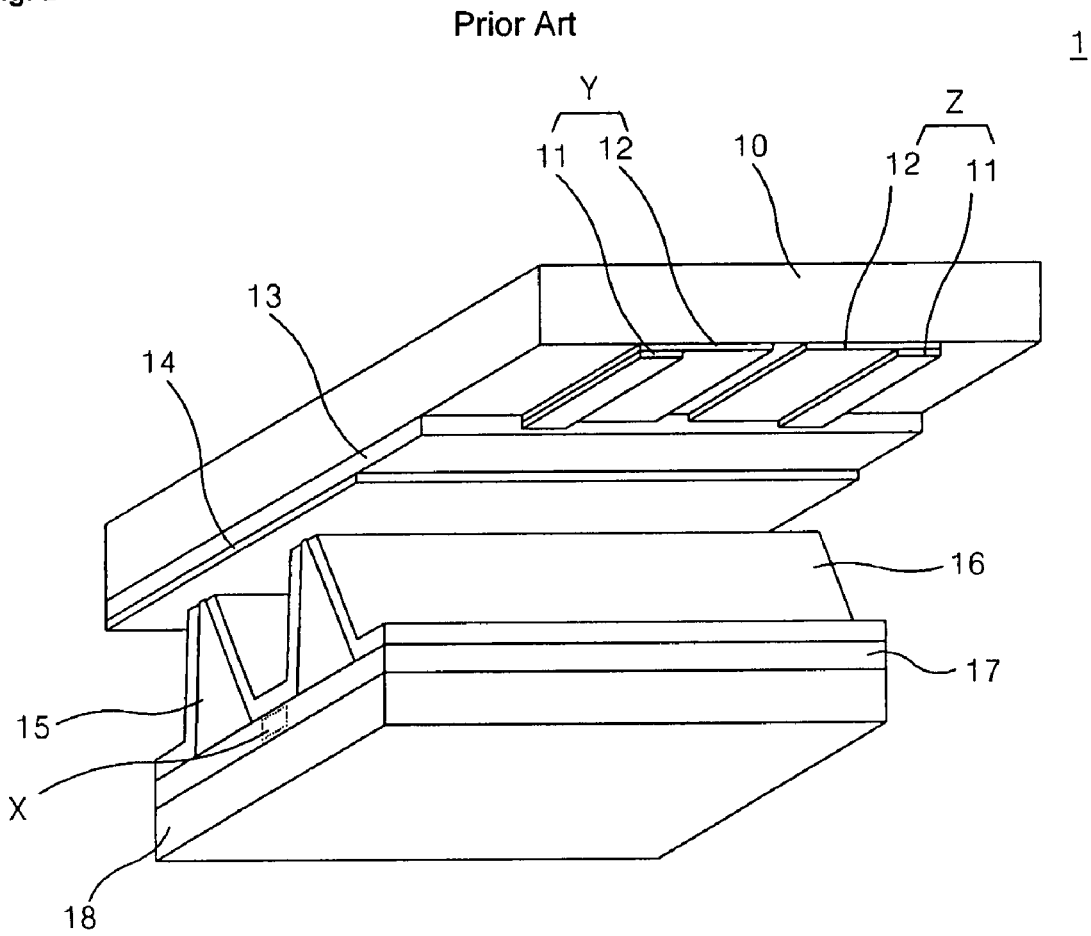
Fig. 2 Prior Art
FIG. 2 shows a perspective view illustrating discharge cell structure of plasma display panel which is shown in FIG. 1.
Figure 3:
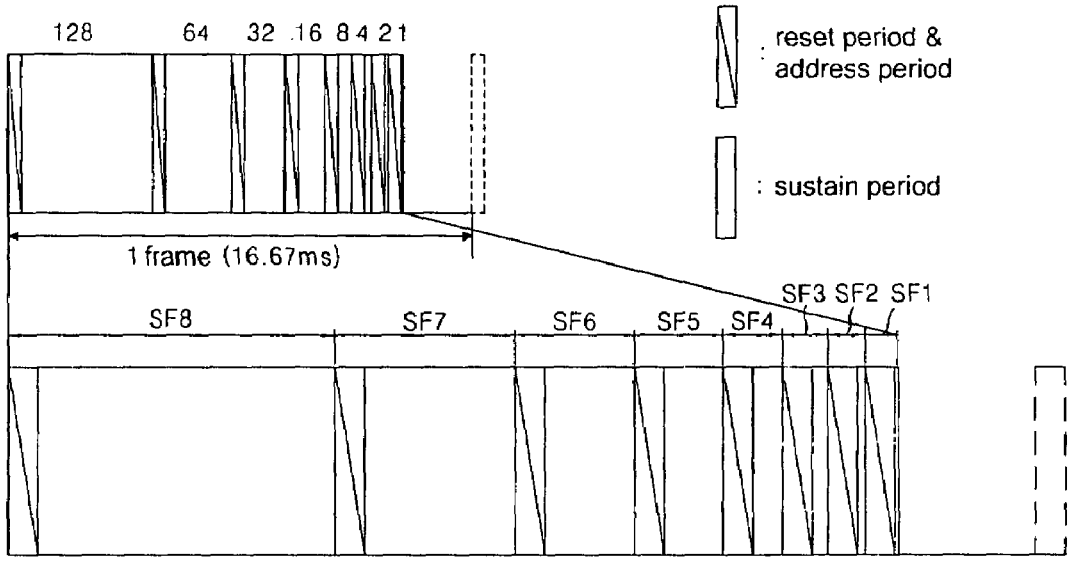
Fig. 3 Prior Art
FIG. 3 shows one frame, which includes 8 subfields, in a method for driving plasma display panel of the background art.

According to an aspect of the present invention, a method for driving a plasma display panel in which pluralities of first electrodes and second electrodes are arranged parallel and to each other adjacently on an upper substrate, a plurality of third electrodes is arranged to cross the pairs of first and second electrodes at electrode crossing areas and define corresponding discharge cells at the electrode crossing areas on an lower substrate, wherein said method for driving a plasma display panel comprises steps of: forming wall charges on the upper and lower substrate by applying first rising ramp waveform to said first electrodes during a first period of a reset period; erasing partly the wall charges which are formed on the upper substrate by applying second rising ramp waveform to said second electrodes (luring a second period of a reset period; erasing partly the wall charges which are formed on the upper and lower substrates by applying falling ramp waveform to said first and second electrodes during a third period of a reset period; selecting the discharge cells by applying data voltage to said third electrodes and applying scan voltage to said first electrodes during a address period; and displaying an image on screen by applying sustain voltage to said first and second electrodes alternatively during a sustain period.

During said first period of the reset period, a ground voltage is applied to said second and third electrodes.

During said second period of the reset period, a ground voltage is applied to said first and third electrodes.

During said second period of the reset period, a falling ramp waveform of a first slope is applied to said first electrodes.

During said second period of the reset period, a falling ramp waveform of a first slope is applied to said first electrodes and, during said third period of the reset period, a falling ramp waveform of a second slope is applied to said first electrodes.

During said second and third period of the reset period, a falling volatge ramp waveform of contant slope is applied to said first electrodes.

During said third period of the reset period, a ground voltage is applied to said third electrodes.

the voltage of said first rising ramp waveform is equal to the voltage of said second rising ramp waveform.

the voltage of said falling ramp waveform, which is applied to said first electrodes, is different from the voltage of said falling ramp waveform which is applied to said second electrodes.

the voltage of said falling ramp waveform, which is applied to said first electrodes, is less than the voltage of said falling ramp waveform, which is applied to said second electrodes.

The slope of said falling ramp waveform, which is applied to said first electrodes, is different from the slope of said falling ramp waveform, which is applied to said second electrodes.

The slope of said falling ramp waveform, which is applied to said first electrodes, is less than the slope of said falling ramp waveform, which is applied to said second electrodes.

Said method comprises further applying de voltage of positive polarity to said third electrodes during said address period.

said dc voltage is less than said sustain voltage.

According to another aspect of the present invention, a method for driving a plasma display panel including an upper substrate on which pluralities of first electrodes and second electrodes are arranged parallel and to each other adjacently and a lower substrate on which a plurality of third electrodes is arranged to cross the pairs of first and second electrodes at electrode crossing areas and define corresponding discharge cells at the electrode crossing areas and wherein, during a reset period, each of the discharge cells is initialized, during an addressing period, wall charges are provided in the discharge cells according to display data and, during a sustain discharge period, sustain discharges are induced in discharge cells in which wall charges are provided during the addressing period, wherein said reset period comprises: first initializing period during which wall charges are formed on the upper and lower substrates; second initializing period during which some of wall charges, formed on the upper substrate, are elimineted; and third initializing period during which some of wall charges, formed on the upper and lower substrates, are erased.

According to an aspect of the present invention, an apparatus for driving a plasma display panel in which pluralities of first electrodes and second electrodes are arranged parallel and to each other adjacently on an upper substrate, a plurality of third electrodes is arranged to cross the pairs of first and second electrodes at electrode crossing areas and define corresponding discharge cells at the electrode crossing areas on an lower substrate, wherein said apparatus for driving a plasma display panel comprises: first electrode driving part which applies first rising ramp waveform to said first electrodes during first period of reset period, applies first falling ramp waveform to said first electrodes during third period of reset period, applies scan voltage to said first electrodes during address period, and then, applies sustain voltage to said first electrodes during sustain period; second electrode driving part which applies second rising ramp waveform to said second electrodes during second period of reset period, applies second falling ramp waveform to said second electrodes during third period of reset period, and then, applies sustain voltage to said second electrodes during sustain period alternatively with said first electrode driving part; and third electrode driving part which applies data voltage to said third electrodes during address period.

According to further aspect of the present invention, a method for driving a plasma display panel in which pluralities of first electrodes and second electrodes are arranged parallel and to each other adjacently on an upper substrate, a plurality of third electrodes is arranged to cross the pairs of first and second electrodes at electrode crossing areas and define corresponding discharge cells at the electrode crossing areas on an lower substrate, wherein said method for driving a plasma display panel comprises steps of: forming wall charges on the upper and lower substrate by applying first rising ramp waveform to said second electrodes during a first period of a reset period; forming further wall charges on the upper and lower substrate by applying second rising ramp waveform to said first electrodes during a second period of a reset period; erasing partly the wall charges which are formed on the upper and lower substrates by applying falling ramp waveform to said first and second electrodes during a third period of a reset period; selecting the discharge cells by applying data voltage to said third electrodes and applying scan voltage to said first electrodes during a address period; and displaying an image on screen by applying sustain voltage to said first and second electrodes alternatively during a sustain period.

Preferred embodiments of the present invention will be described in a more detailed manner with reference to the drawings.

Figure 6:
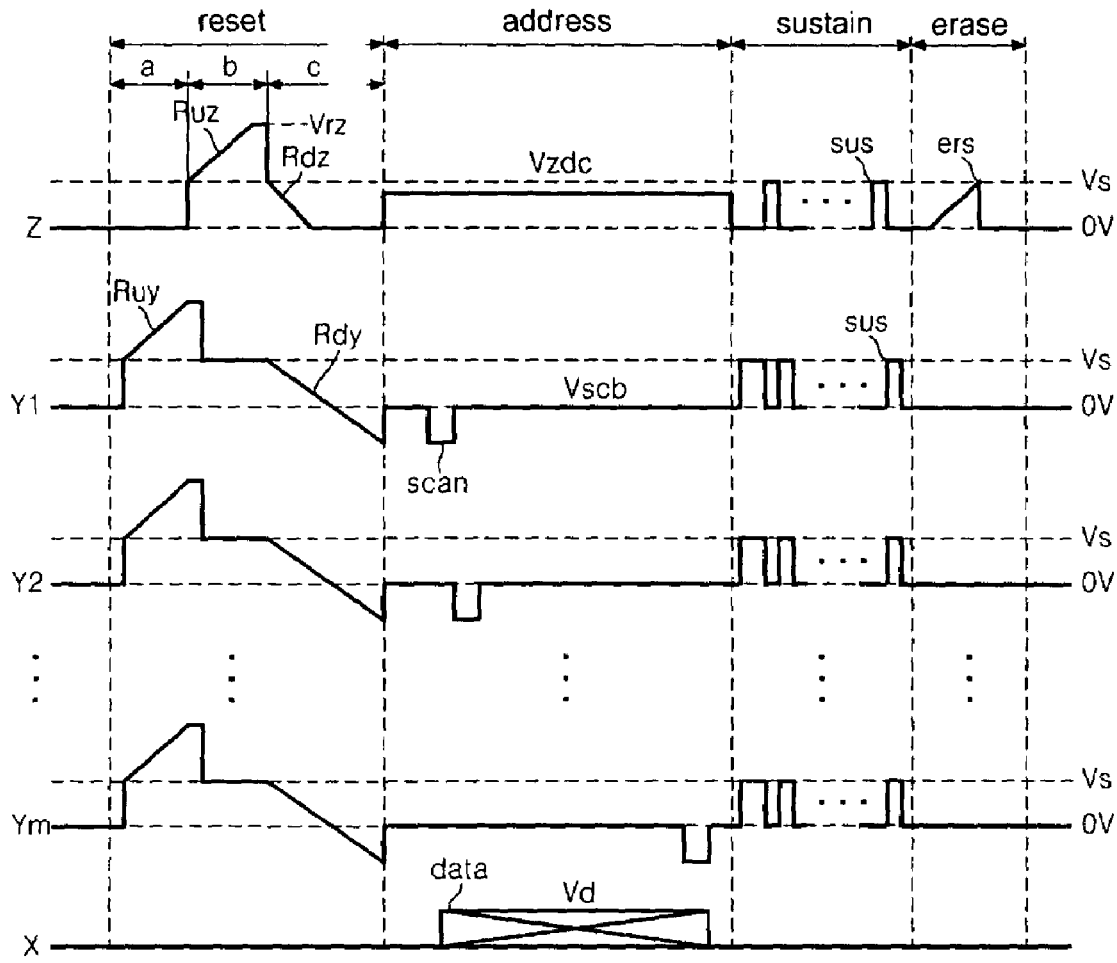
FIG. 6 shows a waveform diagram illustrating a method for driving a plasma display panel according to an aspect of the present invention.
Figure 7:
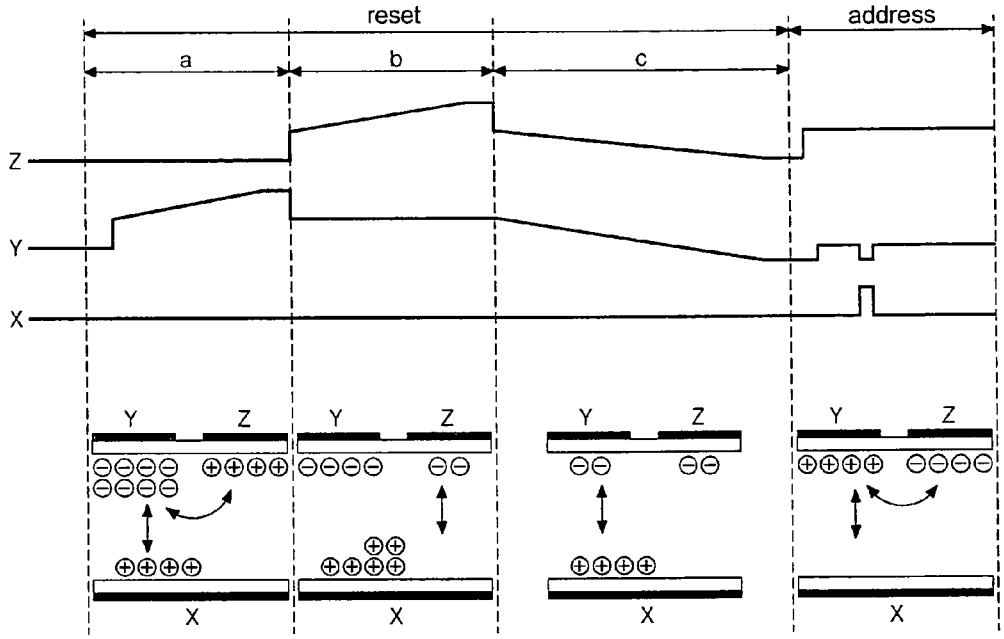
FIG. 7 shows a schematic diagram illustrating the variation of distribution of wall charges in the plasma display panel according to an aspect of the present invention.

FIG. 6 shows a waveform diagram illustrating a method for driving a plasma display panel according to an aspect of the present invention. FIG. 7 shows a schematic diagram illustrating the variation of distribution of wall charges in the plasma display panel according to an aspect of the present invention.

The method for driving a PDP drive one subfield time divisionly with a plurality of subfields which includes individually a reset period, during which each of the discharge cells is initialized, an addressing period, during which off cells are selected and, a sustain discharge period, during which sustain discharges are induced in discharge cells. Among a plurality of subfields, at least one subfield is driven by the driving waveform which is shown in FIG. 6.

As shown in FIG. 6 and FIG. 7, the method for driving PDP applies rising ramp waveform to the scan electrodes Y and the sustain electrodes Z sequentially during the reset period.

During a period, that is first period, of the reset period, a first rising ramp waveform, which rises from sustain voltage Vs to setup voltages Vry, is applied to all the scan electrodes simultaneously. At the same time, O[V] is applied to the sustain electrodes Z and the address electrodes X. This a period is the period during which wall charges are stacked on the electrodes Y, Z of upper substrate and the electrodes X of lower substrates. Little discharge is induced between the scan electrodes Y and the address electrodes X, and between the scan electrodes Y and the sustain electrodes Z in the cells of total screen by the first rising ramp waveform. By this discharge, wall charges of positive polarity are stacked on the address electrodes X and the sustain electrodes Z, and wall charges of negative polarity are stacked on the scan electrodes Y.

During b period, that is second period, of the reset period, a second rising ramp waveform, which rises from sustain voltage Vs to setup voltage Vrz, is applied to all the sustain electrodes simultaneously. At the same time, sustain voltage Vs is applied to the scan electrodes Y and O[V] is applied to the address electrodes X. This b period is the period during which wall charges, which are stacked on the electrodes Y, Z of upper substrate, are erased and wall charges are further stacked on the electrodes X of lower substrate. Little discharge is induced between the sustain electrodes Z and the address electrodes X, and between the scan electrodes Y and the sustain electrodes Z in the cells of total screen by the second rising ramp waveform. At this time, wall charges of negative polarity on the scan electrodes are erased by the scan discharge with the sustain electrodes Z. On the sustain electrodes Z, wall charges of negative polarity are stacked as many as the reducing quantity of wall charges of negative polarity of the scan electrodes Y and wall charges of positive polarity are erased and the polarity of wall charges is reversed to negative polarity. Further, on the address electrodes X, wall charges of positive polarity are further stacked as many as the reducing quantity of wall charges of positive polarity of the sustain electrodes Z by the discharge between the sustain electrodes Z and the address electrodes X.

Figure 4:
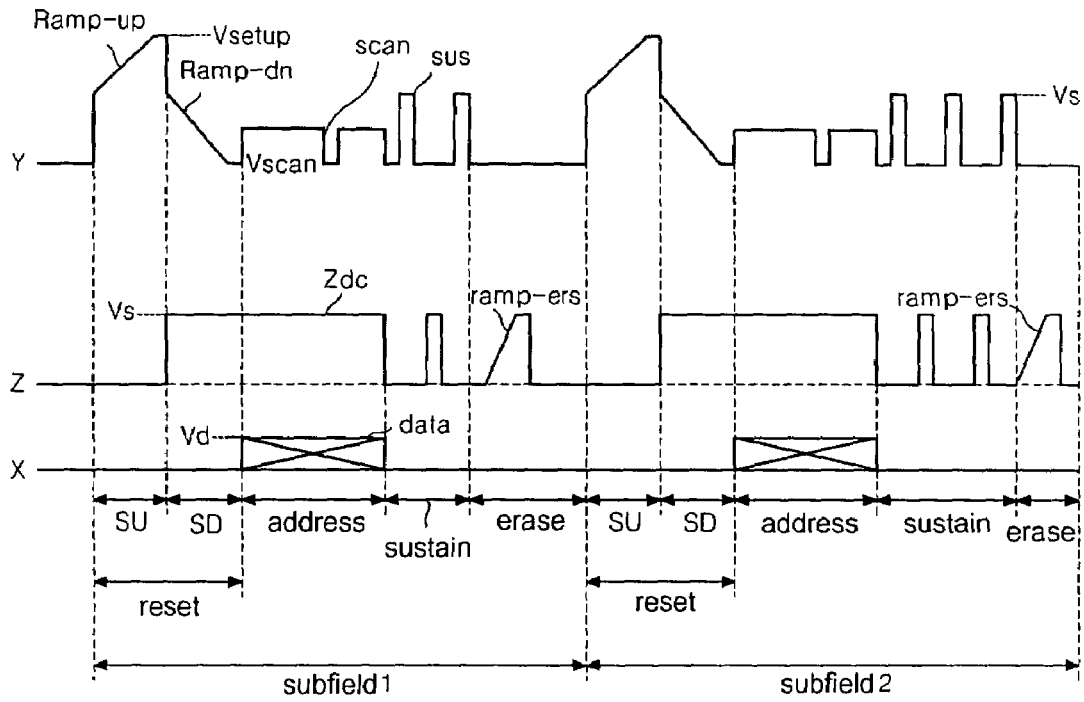
Fig. 4 Prior Art
FIG. 4 shows a waveform diagram illustrating driving waveform of the background art.
Figure 5:
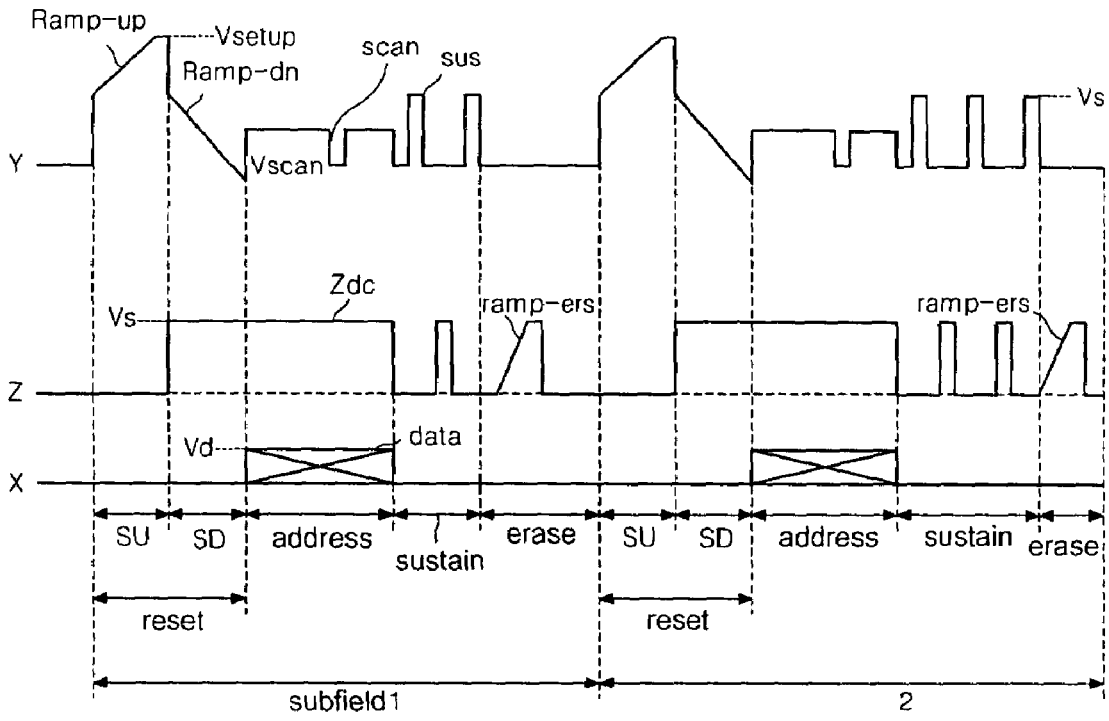
Fig. 5 Prior Art
FIG. 5 shows a waveform diagram illustrating another driving waveform of the background art.

By the driving waveform of the background art which is shown in FIG. 4 and FIG. 5, the quantity of wall charges of positive polarity, which are generated during the setup period and flow to the lower substarte, is little Therefore, the erased quantity of wall charges of positive polarity by erasing wall charges during the setdown period is so much, and the address discharge is unstable. That is, by the driving waveform of the background art, during the address period, the quantity of wall charges of the lower substrate is insufficient and the delay of the address disvharge or the address jitter increase.

According to the method for driving a PDP of the present invention, as one rising ramp waveform Ruy is applied to the scan electrodes Y during a period, and then, other rising ramp waveform Ruz is applied to the sustain electrodes Z, continuous discharges of two times are generated on the lower substrate and wall charges of positive polarity are stacked on the lower substrate continuously. In this case, the quantity of discharge of a period is less than that of the background art. However, wall charges of positive polarity are filled up by the discharge of b period. Therefore, though the voltages Vry, Vrz of the rising ramp waveforms Ruy, Ruz are less than the setup voltage Vsetup of the background art which is shown in FIG. 4 and FIG. 5, wall charges of positive polarity can be stacked on lower substrate enoughly and the discharge delay can be reduced in the address discharge.

The voltages Vry, Vrz of the first and second ramp waveforms Ruy, Ruz can be same or different. And, the slopes of the first and second ramp waveforms Ruy, Ruz can be same or different.

During c period, that is third period, of the reset period, a second falling ramp waveform Rdz, which falls from about sustain voltage Vs to ground voltage or O[V], is applied to all the sustain electrodes Z simultaneously. At the same time, a first falling ramp waveform Rdy, which falls from about the sustain voltage Vs to the voltage of negative polarity Vny, is applied to the scan electrodes Y and O[V] is applied to the address electrodes X. When the falling ramp waveforms Rdz, Rdy are applied like this, a little discharge is generated between the scan electrodes Y and the address electrodes X. By this discharge, wall charges among wall charges generated on the scan electrodes Y the address electrodes X, which are unnecessary for the address discharge, are erased in all the discharge cell.

The voltages Vry, Vrz of the first and second ramp waveforms Rdy, Rdz can be same or different. And, the slopes of the first and second ramp waveforms Rdy, Rdz can be same or different.

In the driving waveform of the background art which is shown in FIG. 4 and FIG. 5, the condition for addressing is meeted by controlling the quantity of wall charges of the upper and lower substrates through generating surface discharge between the scan electrodes Y and the sustain electrodes Z during the setdown period.

In the method for driving a PDP of the present invention, as the quantity of wall charges is controlled by only opposite discharge between the scan electrodes Y and the address electrodes X during c period and the voltage −Vny is controlled appropriately, the controlling of wail charges for the address discharge becomes easier and wall charges for the address discharge can be erased appropriately. Therefore, the address driving can be more stable. And, the present invention can make the address driving margin large and reduce the address discharge delay by implementing the ideal initial condition for the address discharge.

During the address period, the scan pulse SP of the negative polarity is sequentially applied to the scan electrodes Y and at the same time the data pulse DP of the positive polarity is synchronized with the scan pulse SP and applied to the address electrodes X. As the voltage difference between the scan pulse SP and the data pulse DP and the wall voltage generated in the reset period are added, an address discharge is generated within a cell to which the data pulse DP is applied. Wall charges are generated within the cell selected by the address discharge and the wall charges can generate discharge by applying the sustain voltage Vs. During this address period, positive polarity dc voltage Vzdc is applied to the sustain electrodes Z.

In the driving waveform of the background art which is shown in FIG. 4 and FIG. 5, the dc voltage Vzdc, which is applied to the sustain electrodes Z during the address period, is the sustain voltage Vs. This dc voltage Vzdc is used for stacking wall charges of negative polarity stably on the sustain electrodes Z.

In the method for driving a PDP of the present invention, as wall charges of negative polarity are stacked enoughly on the sustain electrodes Z by the discharge generated by the rising ramp waveform Ruz, which is applied during b period, the dc voltage Vzdc can be smaller and this small dc voltage Vzdc can do same role with the dc voltage Zdc, which is the sustain voltage Vs, of the background art. That is, the driving method of the present invention can make the dc voltage Vzdc, which is applied to the sustain electrodes Z during the address period, smaller than the sustain voltage Vs.

During the sustain period, sustain pulses SUS are alternately applied to the scan electrodes Y and the sustain electrodes Z. Then, in the cell selected by the address discharge, sustain discharge, that is display discharge, is generated between the scan electrodes Y and the sustain electrodes Z every time when every sustain pulse is applied, while the wall voltage and the sustain pulse SUS within the cell are added thereto.

In the erase period following the sustain period, wall charges, which remain in the cells of the total screen, are erased by applying the erase ramp waveform RAMP-ERS, of which the pulse width is narrow and the voltage level is low, to the sustain electrodes Z.

Figure 8:
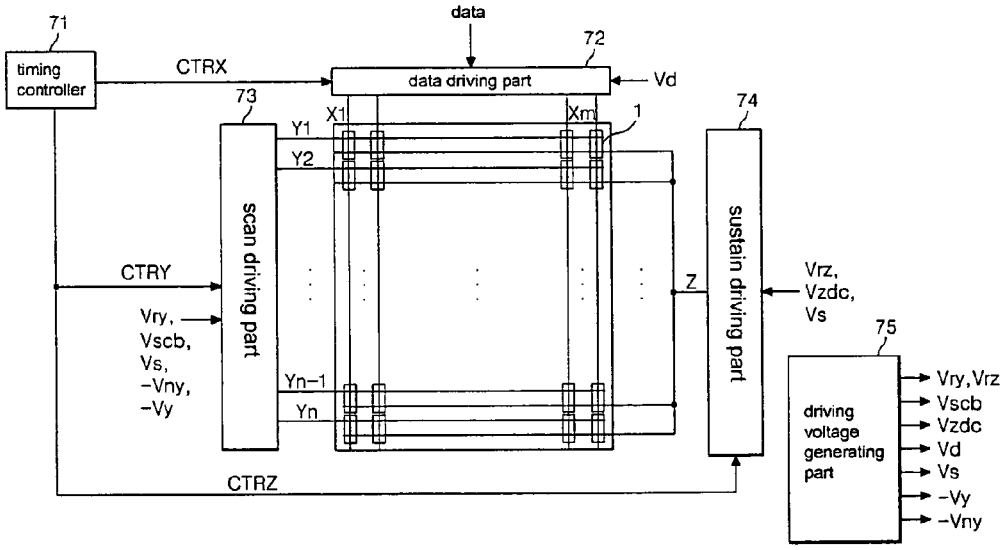
FIG. 8 shows a block diagram illustrating an apparatus for driving the plasma display panel according to an aspect of the present invention.

FIG. 8 shows a block diagram illustrating an apparatus for driving the plasma display panel according to an aspect of the present invention.

As shown in FIG. 8, the apparatus for driving a PDP according to an aspect of the present invention comprises: data driving part 72 for applying data to the address electrodes X1 through Xm; scan driving part 73 for driving the scan electrodes Y1 through Yn; sustain driving part 74 for driving the sustain electrodes Z which are common electrodes; timing controller 71 for controlling each driving part 72, 73, 74; and driving voltage generating part 75 for applying driving voltage to each driving part 72, 73, 74.

Data, which is revised by inverted gamma revision circuit, is diffused by error diffusion circuit, and is mapped to each subfield by subfield mapping circuit, is applied to the data driving part 72. This data driving part 72 samples and latches the data responding timing control signal CTRX of the timing controller 71, and then applies the data to the address electrodes X1 through Xm.

The scan driving part 73 applies first rising ramp waveform Ruy during a period, sustain voltage Vs during b period, and first falling ramp waveform Rdy during c period to the can electrodes Y1 through Yn by control of the timing controller 71. And, the scan driving part 73 applies scan pulse SCAN sequentially during the address period, and then applies sustain pulse SUS during the sustain period to the scan electrodes Y1 through Yn by control of the timing controller 71.

The sustain driving part 74 applies ground voltage GND or O[V] during a period, second rising rampform Ruz during b period, and second falling ramp waveform during c period, to the sustain electrodes Z by control of the timing controller 71. And, the sustain driving part 74 applies de voltage Vzdc which is smaller than the sustain voltage Vs during the address period, and then applies sustain pulse SUS alternatively with the scan driving part 73 during the sustain period to the scan electrodes Y1 through Yn by control of the timing controller 71.

The timing controller 71 controls each driving part 72, 73, 74 by being inputted with vertical/horizontal synchronizing signal, generating timing control signal CTRX, CTRY, CTRZ for each driving part, and applying the timing control signal CTRX, CTRY, CTRZ to corresponding driving part 72, 73, 74. The data control signal CTRX includes sampling clock for sampling data, latch control signal, and switch control signal for controlling on/off time of energy recovery circuit and driving switches. The scan control signal CTRY includes switch control signal for controlling on/off time of energy recovery circuit and driving switches in the scan driving part 73. The sustain control signal CTRZ includes switch control signal for controlling on/off time of energy recovery circuit and driving switches in the sustain driving part 73.

The driving voltage generating part 75 generates the voltages Vry, Vrz of rising ramp waveform Ruy, Ruz, the voltage −Vny of falling ramp waveform Rdy, the dc voltage Vzdc applied to the sustain electrodes Z during address period, scan bias voltage Vscb, scan voltage −Vy, sustain voltage Vs, and data voltage Vd. These voltages can be varied by composition of discharge gas or structure of discharge cell.

Figure 9:
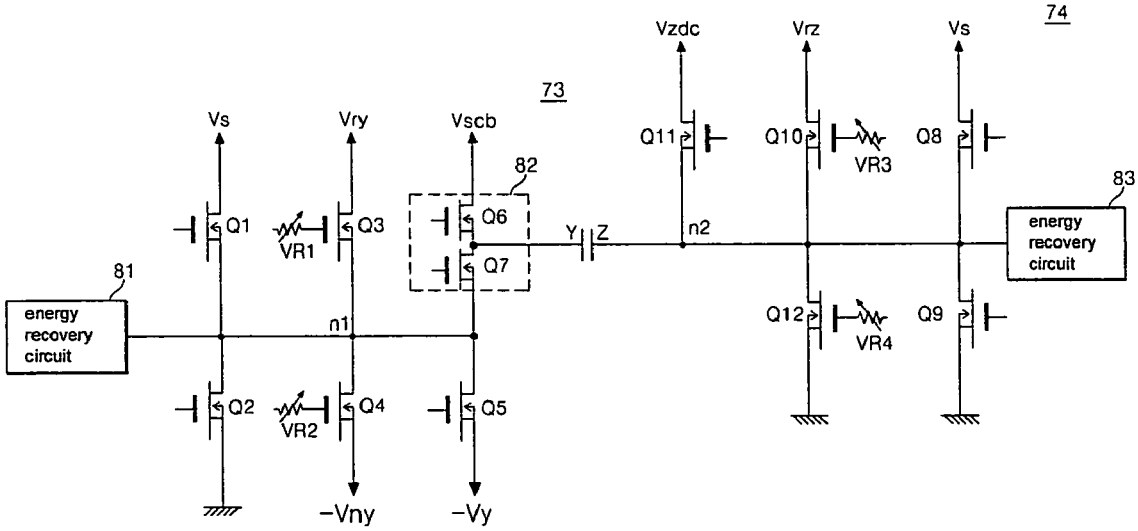
FIG. 9 shows a circuit diagram illustrating the scan driving pert and the sustain driving part of the apparatus which is shown in FIG. 8.
Figure 10:
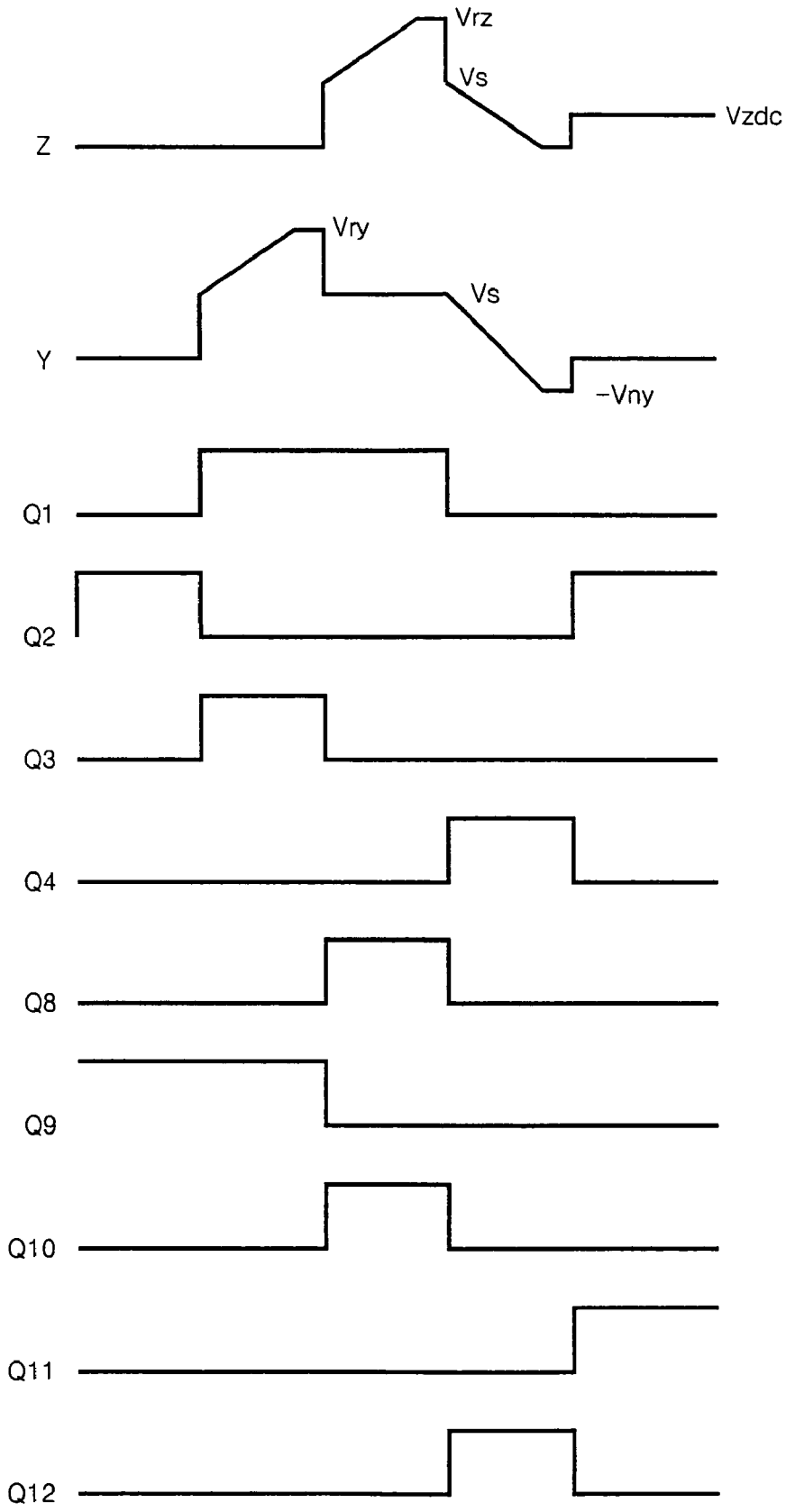
FIG. 10 shows a waveform diagram illustrating on/off of the switch devices which are shown in FIG. 9.

FIG. 9 shows a circuit diagram illustrating the scan driving part and the sustain driving part of the apparatus which is shown in FIG. 8. FIG. 10 shows a waveform diagram illustraing on/off of the switch devices which are shown in FIG. 9.

As show in FIG. 9 and FIG. 10, the scan driving part 73 includes energy recovery circuit 81, driving switch circuit 82, first through fifth switches Q1 through Q5.

The energy recovery circuit 81 recovers the energy of noneffective power which did not contribute to discharge of PDP from the scan electrodes Y and charges the scan electrodes Y with this recovered energy. This energy recovery circuit 81 can be any energy recovery circuit which is known.

The driving switch circuit 82 includes sixth and seventh switches Q5, Q6 which connects scan bias voltage source Vscan-com to first node n1 as push-pull form. The output terminal between sixth and seventh swiches is connected to the scan electrodes Y.

The first switch Q1 is connected between the sustain voltage source Vs and the first node n1 and applies the sustain voltage Vs to the first node n1 by control of the timing controller 71.

The second switch Q2 is connected between the ground voltage source GND and the first node n1 and applies the ground voltage GND to the first node n1 by control of the timing controller 71.

The third switch Q3 is connected between the rising ramp voltage source Vry and the first node n1 and applies first rising ramp waveform Ruy to the first node n1 with slope fixed according to pre-determined RC time constant by control of the timing controller 71. Variable resistor VR1 for controlling the slope of first rising ramp waveform Ruy and capacitor which is not shown are connected to the control terminal of the third switch Q3.

The fourth switch Q4 is connected between the falling ramp voltage source −Vny and the first node n1 and applies first falling ramp waveform Rdy to the first node n1 with slope fixed according to pre-determined RC time constant by control of the timing controller 71. Variable resistor VR2 for controlling the slope of first falling ramp waveform Rdy and capacitor which is not shown are connected to the control terminal of the fourth switch Q4.

The fifth switch Q5 is connected between the scan voltage source Vscan and the first node n1 and applies the scan voltage −Vy to the first node n1 by control of the timing controller 71.

The sustain driving part 74 includes the energy recovery circuit 83 and eighth through twelfth switches Q8 through Q12.

The energy recovery circuit 83 recovers the energy of noneffective power which did not contribute to discharge of PDP from the sustain electrodes Z and charges the sustain electrodes Z with this recovered energy. This energy recovery circuit 83 can be any energy recovery circuit which is known.

The eighth switch Q8 is connected between the sustain voltage source Vs and the second node n2 and applies the sustain voltage Vs to the second node n2, that is the sustain electrodes Z by control of the timing controller 71.

The ninth switch Q9 is connected between the ground voltage source GND and the second node n2 and applies the ground voltage GND to the second node n2 by control of the timing controller 71.

The tenth switch Q10 is connected between the rising ramp voltage source Vrz and the second node n2 and applies second rising ramp waveform Ruz to the second node n2 with slope fixed according to pre-determined RC time constant by control of the timing controller 71. Variable resistor VR3 for controlling the slope of second rising ramp waveform Ruz and capacitor which is not shown are connected to the control terminal of the tenth switch Q10.

The eleventh switch Q11 is connected between the dc voltage source Vzdc which is less than the sustain voltage Vs and the second node n2 and applies the dc voltage Vzdc to the second node n2 by control of the timing controller 71.

The twelfth switch Q12 is connected between the ground voltage source GND and the second node n2 and applies second falling ramp waveform Rdz to the second node n2 with slope fixed according to pre-determined RC time constant by control of the timing controller 71. Variable resistor VR4 for controlling the slope of second falling ramp waveform Rdz and capacitor which is not shown are connected to the control terminal of the twelfth switch Q12.

Figure 11:
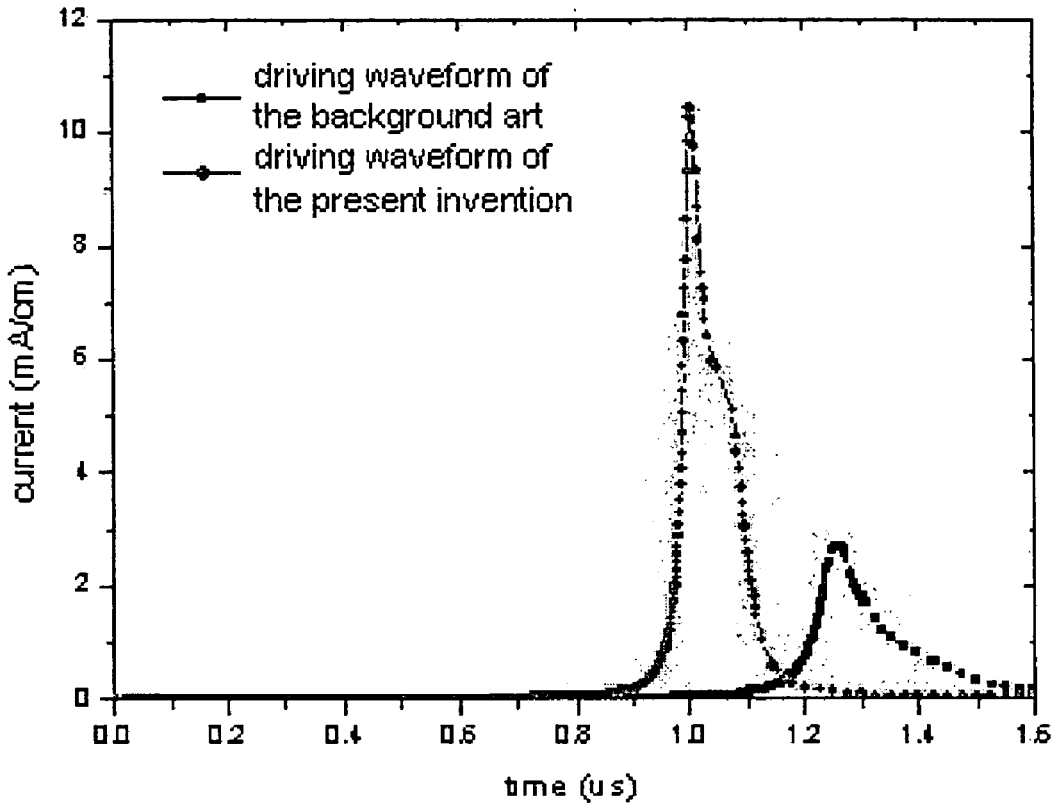
FIG. 11 and FIG. 12 show graphs illustrating the results of simulations which derive a plasma display panel with the driving waveforms of the background art and the present invention.
Figure 12:
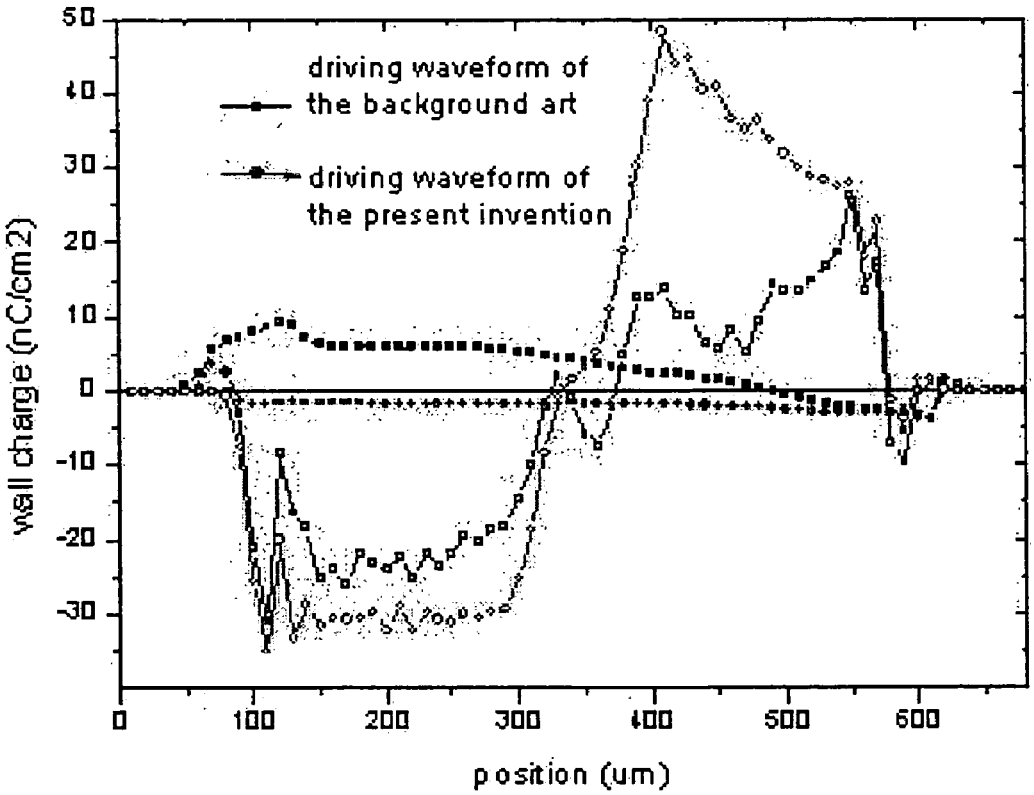

FIG. 11 and FIG. 12 show graphs illustrating the results of simulations which derive a plasma display panel with the driving waveforms of the background art and the present invention. As shown in FIG. 11, if the PDP is drived by the driving waveform of the present invention, discharge is generated faster and stronger than the background art.

As shown in FIG. 12, if the PDP is drived by the driving waveform of the present invention, the quantity of wall charges generated by the address discharge increases and accordingly, the sustain discharge becomes faster and more stable. By this reason, the driving margin becomes enough in low gradation as well as high gradation.

Figure 13:
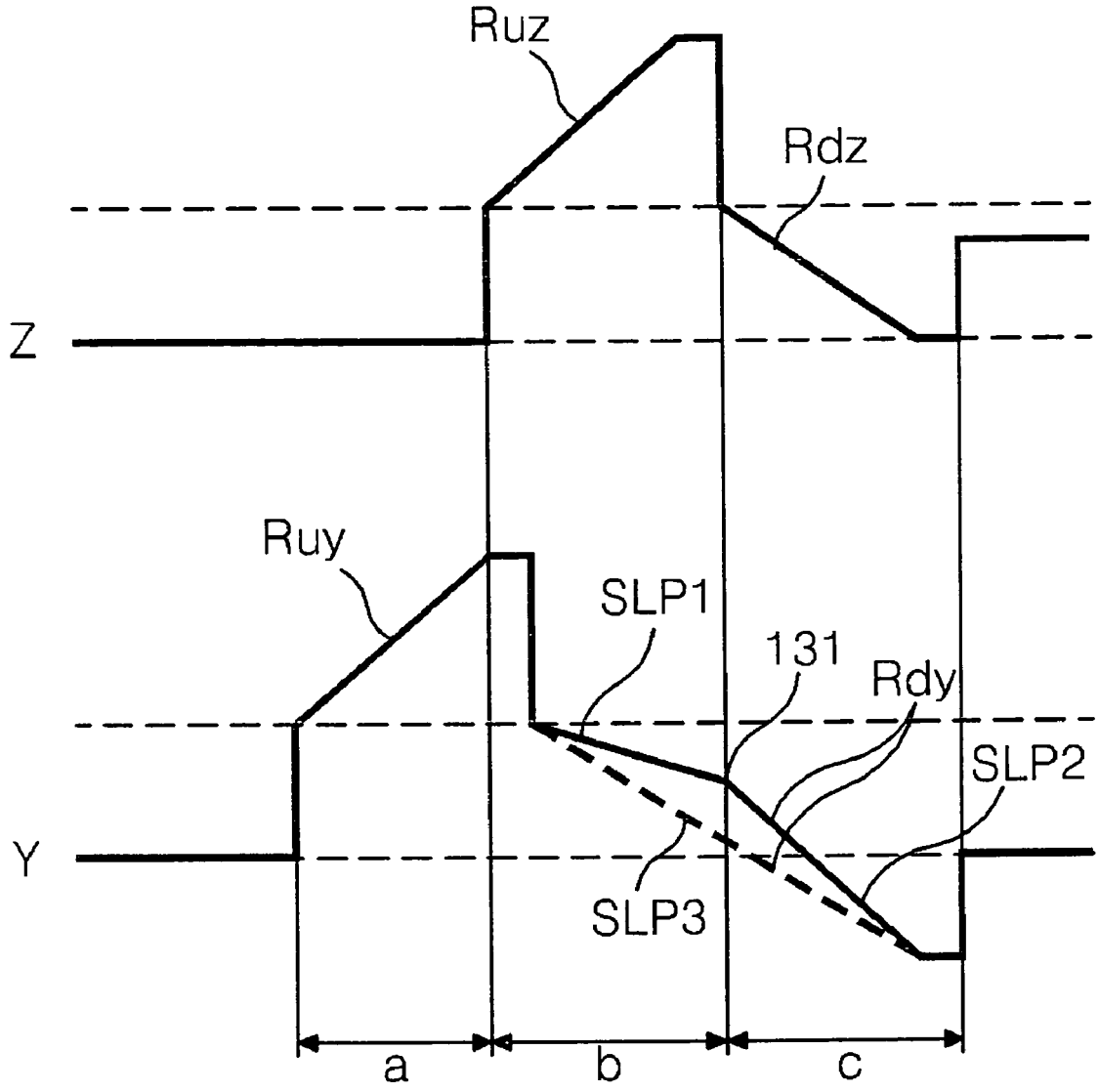
FIG. 13 shows a method for driving plasma display panel according to another aspect of the present invention.

FIG. 13 shows a method for driving plasma display panel according to another aspect of the present invention.

As shown in FIG. 13, the a period of the reset period is equal to that of FIG. 6 and FIG. 7.

During b period, that is second period, of the reset period, a second rising ramp waveform Ruz, which rises from about sustain violtage Vs to setup voltage Vrz, is applied to the sustain electrodes and falling ramp waveform Rdy of first slope SLP1 or third slope SLP3 is applied to the scan electrodes. At the same time, sustain voltage Vs is applied to the scan electrodes Y and O[V] is applied to the address electrodes X. This b period is the period during which wall charges, which are stacked on the electrodes Y, Z of upper substrate, are erased partly and wall charges are further stacked on the electrodes X of lower substrate. Little discharge is generated between the sustain electrodes Z and the address electrodes X, and between the scan electrodes Y and the sustain electrodes Z in the cells of total screen by the second rising ramp waveform. Here, as the voltage of the scan electrodes Y is decreased by the failing ramp waveform Rdy, the discharge between the scan electrodes Y and the sustain electrodes Z is generated better than the embodiment of FIG. 6 and FIG. 7. As the discharge between the scan electrodes Y and the sustain electrodes Z is strong and stable comparatively, the driving margin becomes larger.

During c period, that is third period, of the reset period, a second falling ramp waveform Rdz, which falls from about sustain voltage Vs to ground voltage GND or O[V], is applied to the sustain electrodes Z and first falling ramp waveform Rdy of first slope SLP2 which falls from the voltage of singular point to the voltage −Vny or third slope SLP3 which falls from b period to the voltage −Vny is applied to the scan electrodes Y. At the same time, O[V] is applied to the address electrodes X. When these) falling ramp waveforms Rdz, Rdy are applied, little discharge is generated between the scan electrodes Y and the address electrodes X. By this discharge, wall charges among wall charges generated on the scan electrodes Y the address electrodes X, which are unnecessary for the address discharge, are erased in all the discharge cell.

Figure 14:
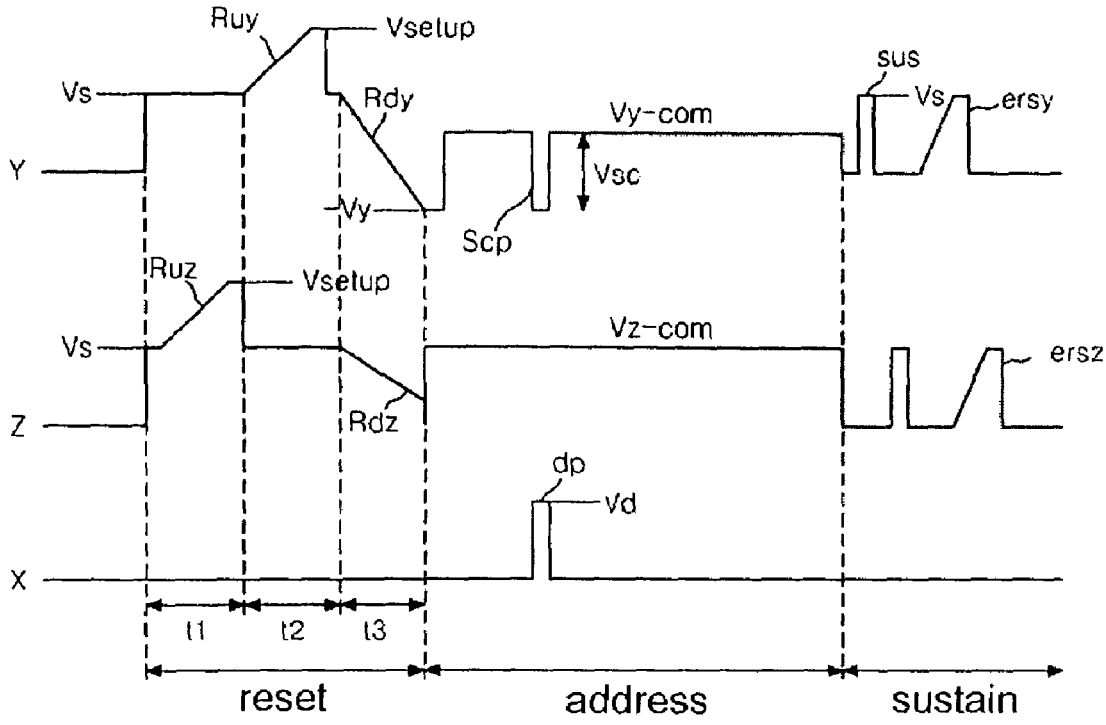
FIG. 14 shows a waveform diagram illustrating a method for driving plasma display panel according to further aspect of the present invention.
Figure 15:
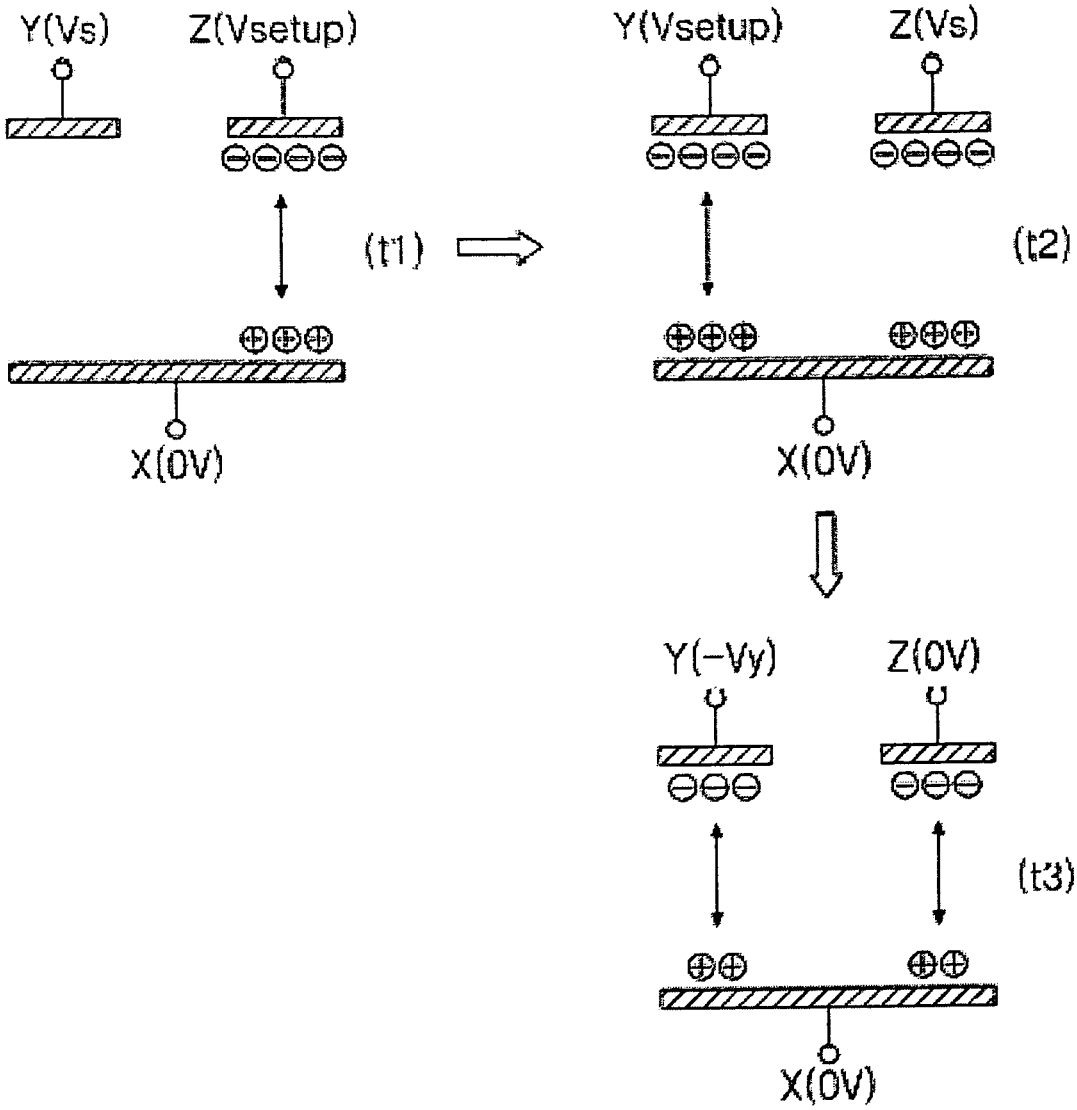
FIG. 15 shows a shematic diagram illustrating the variation of distribution of wall charges which are generated by the driving waveform of FIG. 14.

FIG. 14 shows a waveform diagram illustrating a method for driving plasma display panel according to further aspect of the present invention. FIG. 15 shows a shematic diagram illustrating the variation of distribution of wall charges which are generated by the driving waveform of FIG. 14.

Figure 16:
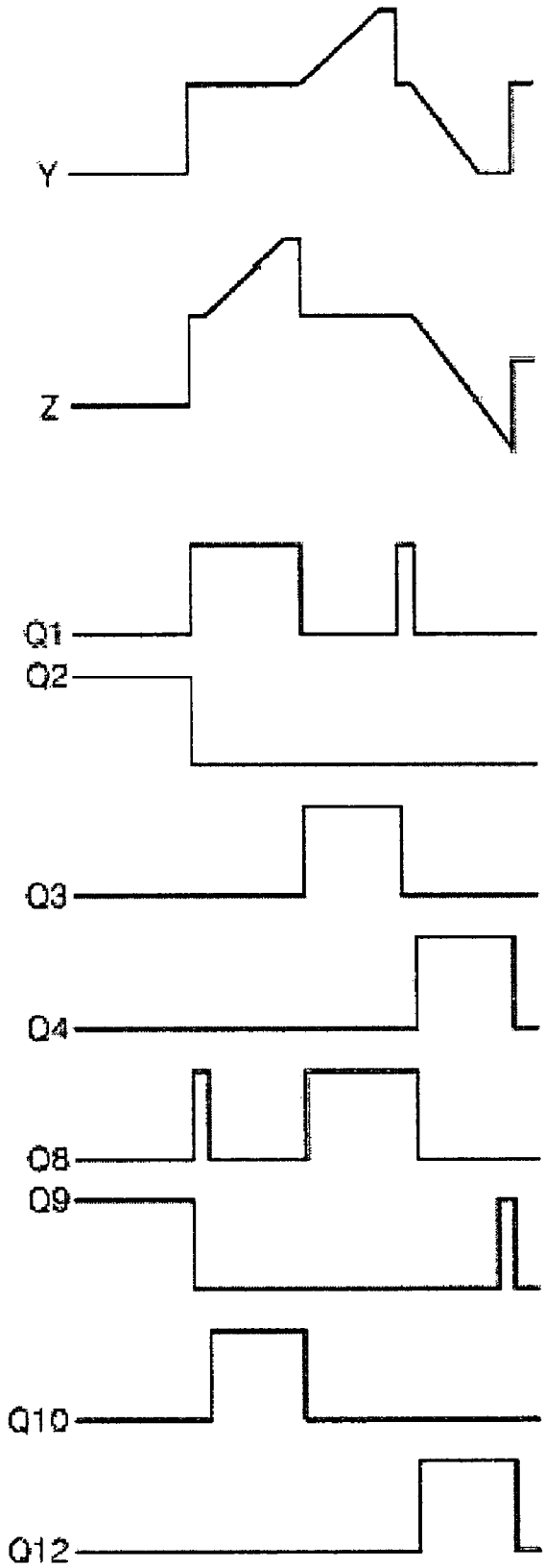
FIG. 16 shows a waveform diagram illustraing on/off of the switch devices according to the driving waveform of FIG. 14.

FIG. 16 shows a waveform diagram illustraing on/off of the switch devices according to the driving waveform of FIG. 14.

As shown in FIG. 14 and FIG. 15, during t1 period, that is first period, of the reset period, the sustain voltage Vs is applied to the scan electrodes Y and rising ramp waveform Ruz which rises from the sustain voltage Vs to the setup voltage Vsetup is applied to the sustain electrodes Z. During this t1 period, ground voltage GND or O[V] is applied to the address electrodes X. Little discharge, that is writing discharge, is generated between the scan electrodes Y and the address electrodes X in the cells of total screen. By this first writing discharge, wall charges of negative polarity are stacked on the sustain electrodes Y and wall charges of positive polarity are stacked on the address electrodes X.

During t2 period, that is second period, of the reset period, rising ramp waveform Ruy which rises from the sustain voltage Vs to the setup voltage Vsetup is applied to the scan electrodes Y and the sustain voltage is applied to the sustain electrodes Z. During this t2 period, ground voltage GND or O[V] is applied to the address electrodes X. Little discharge, that is writing discharge, is generated between the scan electrodes Y and the address electrodes X in the cells of total screen. By this second writing discharge, wall charges of negative polarity-are stacked on the sustain electrodes Y and wall charges of positive polarity are stacked on the address electrodes X. On the other hand, the sustain voltage Vs is applied to the sustain electrodes Z. However, the discharge between the sustain electrodes Z and the address electrodes X is hardly generated. The reason is because the voltage difference between the sustain electrodes Z and the address electrodes X is less than the discharge starting voltage by wall charges of negative polarity stacked on the sustain electrodes Z. And, the discharge between the scan electrodes Y and the sustain electrodes Z is hardly generated. The reason is because the voltage difference between the scan electrodes Y and the sustain electrodes Z is less than the discharge starting voltage. Therefore, after t1 and t2 periods, the distribution of wall discharges on the scan electrodes Y hardly varies and the wall charges on the sustain electrodes Z and the address electrodes X are stacked more.

During t3 period, that is third period, of the reset period, a second falling ramp waveform Rdy, which falls from about sustain voltage Vs to the voltage −Vy, is applied to the scan electrodes Y and falling ramp waveform Rdz, which falls from about sustain voltage Vs to ground voltage GND or O[V]. During this t3 period, ground voltage GND or O[V] is applied to the address electrodes X. Little discharge, that is erasing discharge, is generated between the scan electrodes Y and the address electrodes X and between the sustain electrodes Z and the address electrodes X. By this erasing discharge, wall charges which are unnecessary for the address discharge, are erased in all the discharge cell and uniform wall charges remain in all the cells.

The description about the address and the sustain periods will be abbreviated because this is substantially equal to the embodiments which is described above.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method for driving a plasma display panel in which pluralities of first electrodes and second electrodes are arranged parallel to each other adjacently on an upper substrate, a plurality of third electrodes is arranged to cross the pairs of first and second electrodes at electrode crossing areas and define corresponding discharge cells at the electrode crossing areas on an lower substrate, wherein said method for driving a plasma display panel comprises:

forming wall charges on the upper and lower substrate by applying first rising ramp waveform to said first electrodes during a first period of a reset period;

erasing partly the wall charges which are formed on the upper substrate by applying second rising ramp waveform to said second electrodes during a second period of a reset period;

erasing partly the wall charges which are formed on the upper and lower substrates by applying falling ramp waveform to said first and second electrodes during a third period of a reset period;

selecting the discharge cells by applying data voltage to said third electrodes and applying scan voltage to said first electrodes during a address period; and displaying an image on screen by applying sustain voltage to said first and second electrodes alternatively during a sustain period.

2. The method for driving a plasma display panel of claim 1, wherein, during said first period of the reset period, a ground voltage is applied to said second and third electrodes.

3. The method for driving a plasma display panel of claim 1, wherein, during said second period of the reset period, sustain voltage is applied to said first electrodes and a ground voltage is applied to said third electrodes.

4. The method for driving a plasma display panel of claim 1, wherein, during said second period of the reset period, a falling ramp waveform of a first slope is applied to said first electrodes.

5. The method for driving a plasma display panel of claim 1, wherein, during said second period of the reset period, a falling ramp waveform of a first slope is applied to said first electrodes and, during said third period of the reset period, a falling ramp waveform of a second slope is applied to said first electrodes.

6. The method for driving a plasma display panel of claim 1, wherein, during said second and third period of the reset period, a falling ramp waveform of constant slope is applied to said first electrodes.

7. The method for driving a plasma display panel of claim 1, wherein, during said third period of the reset period, a ground voltage is applied to said third electrodes.

8. The method for driving a plasma display panel of claim 1, wherein the voltage of said first rising ramp waveform is equal to the voltage of said second rising ramp waveform.

9. The method for driving a plasma display panel of claim 1, wherein the voltage of said falling ramp waveform, which is applied to said first electrodes, is different from the voltage of said falling ramp waveform, which is applied to said second electrodes.

10. The method for driving a plasma display panel of claim 9, wherein the voltage of said falling ramp waveform, which is applied to said first electrodes, is less than the voltage of said falling ramp waveform, which is applied to said second electrodes.

11. The method for driving a plasma display panel of claim 1, wherein the slope of said falling ramp waveform, which is applied to said first electrodes, is different from the slope of said falling ramp waveform, which is applied to said second electrodes.

12. The method for driving a plasma display panel of claim 11, wherein the slope of said falling ramp waveform, which is applied to said first electrodes, is less than the slope of said falling ramp waveform, which is applied to said second electrodes.

13. The method for driving a plasma display panel of claim 1, wherein said method comprises further applying dc voltage of positive polarity to said third electrodes during said address period.

14. The method for driving a plasma display panel of claim 13, wherein said dc voltage is less than said sustain voltage.

15. An apparatus for driving a plasma display panel in which pluralities of first electrodes and second electrodes are arranged parallel to each other adjacently on an upper substrate, a plurality of third electrodes is arranged to cross the pairs of first and second electrodes at electrode crossing areas and define corresponding discharge cells at the electrode crossing areas on an lower substrate, wherein said apparatus for driving a plasma display panel comprises:

first electrode driving part which applies first rising ramp waveform to said first electrodes during first period of reset period, applies first falling ramp waveform to said first electrodes during third period of reset period, applies scan voltage to said first electrodes during address period, and then, applies sustain voltage to said first electrodes during sustain period;

second electrode driving part which applies second rising ramp waveform to said second electrodes during second period of reset period, applies second falling ramp waveform to said second electrodes during third period of reset period, and then, applies sustain voltage to said second electrodes during sustain period alternatively with said first electrode driving part; and third electrode driving part which applies data voltage to said third electrodes during address period.

16. The apparatus for driving a plasma display panel of claim 15, wherein said second electrode driving part applies ground voltage to said second electrodes during said first period of the reset period, and said third electrode driving part applies ground voltage to said third electrodes during said first period of the reset period.

17. The apparatus for driving a plasma display panel of claim 15, wherein said first electrode driving part applies sustain voltage to said first electrodes during said second period of the reset period, and said third electrode driving part applies ground voltage to said third electrodes during said second period of the reset period.

18. The apparatus for driving a plasma display panel of claim 15, wherein said first electrode driving part applies falling ramp waveform of first slope to said first electrodes during said second period of the reset period.

19. The apparatus for driving a plasma display panel of claim 15, wherein said first electrode driving part applies falling ramp waveform of first slope to said first electrodes during said second period of the reset period and applies falling ramp waveform of second slope to said first electrode during said third period of the reset period.

20. The apparatus for driving a plasma display panel of claim 15, wherein said first electrode driving part applies falling ramp waveform of constant slope to said first electrodes during said second and third periods of the reset period.

21. The apparatus for driving a plasma display panel of claim 15, wherein said third electrode driving part applies ground voltage to said third electrodes during said third period of the reset period.

22. The apparatus for driving a plasma display panel of claim 15, wherein the voltage of said first rising ramp waveform is equal to the voltage of said second rising ramp waveform.

23. The apparatus for driving a plasma display panel of claim 15, wherein the voltage of said first falling ramp waveform is different from the voltage of said second falling ramp waveform.

24. The apparatus for driving a plasma display panel of claim 23, wherein the voltage of said first falling ramp waveform is less than the voltage of said second falling ramp waveform.

25. The apparatus for driving a plasma display panel of claim 15, wherein the slope of said first falling ramp waveform is different from the slope of said second falling ramp waveform.

26. The apparatus for driving a plasma display panel of claim 25, wherein the slope of said first falling ramp waveform is less than the slope of said second falling ramp waveform.

27. The apparatus for driving a plasma display panel of claim 15, wherein said third electrode driving part applies dc voltage of positive polarity to said third electrodes during said address period.

28. The apparatus for driving a plasma display panel of claim 27, wherein said dc voltage is less than said sustain voltage.

29. A method for driving a plasma display panel in which pluralities of first electrodes and second electrodes are arranged parallel and to each other adjacently on an upper substrate, a plurality of third electrodes is arranged to cross the pairs of first and second electrodes at electrode crossing areas and define corresponding discharge cells at the electrode crossing areas on an lower substrate, wherein said method for driving a plasma display panel comprises;

forming wall charges on the upper and lower substrate by applying first rising ramp waveform to said second electrodes during a first period of a reset period;

forming further wall charges on the upper and lower substrate by applying second rising ramp waveform to said first electrodes during a second period of a reset period;

erasing partly the wall charges which are formed on the upper and lower substrates by applying falling ramp waveform to said first and second electrodes during a third period of a reset period;

selecting the discharge cells by applying data voltage to said third electrodes and applying scan voltage to said first electrodes during a address period; and displaying an image on screen by applying sustain voltage to said first and second electrodes alternatively during a sustain period.

* * * * *